US011827427B2

(12) United States Patent
Zamir et al.

(10) Patent No.: US 11,827,427 B2
(45) Date of Patent: Nov. 28, 2023

(54) SHIPPING APPARATUS

(71) Applicant: Nalto Marketing Ltd., Ganei Am (IL)

(72) Inventors: Amnon Zamir, Haifa (IL); John Kowarsky, Ganei Am (IL)

(73) Assignee: Nalto Marketing Ltd., Moshav Ganei Am (IL)

( * ) Notice: Subject to any disclaimer, the term of this patent is extended or adjusted under 35 U.S.C. 154(b) by 109 days.

(21) Appl. No.: 17/670,650

(22) Filed: Feb. 14, 2022

(65) Prior Publication Data

US 2022/0402647 A1 Dec. 22, 2022

Related U.S. Application Data

(60) Provisional application No. 63/213,255, filed on Jun. 22, 2021.

(51) Int. Cl.
*B65D 5/00* (2006.01)
*B65D 5/44* (2006.01)
*B65D 5/46* (2006.01)

(52) U.S. Cl.
CPC ..... *B65D 5/0075* (2013.01); *B65D 5/46016* (2013.01); *B65D 5/005* (2013.01); *B65D 5/445* (2013.01)

(58) Field of Classification Search
CPC .... B65D 5/0015; B65D 5/005; B65D 5/0075; B65D 5/006; B65D 5/445; B65D 5/441; B65D 2519/00641; B65D 21/0209; B65D 85/30; Y10S 229/915; Y10S 229/919; Y10S 206/821
USPC ..... 229/199, 915, 919; 206/423, 503, 521
See application file for complete search history.

(56) References Cited

U.S. PATENT DOCUMENTS 2,663,104 A * 12/1953 Hoagland ..... G09F 1/00 211/49.1
3,292,796 A * 12/1966 Paige ..... A47F 5/114 211/132.1
4,351,246 A * 9/1982 Hutchins, Jr. ..... A47B 47/06 108/156
5,143,283 A * 9/1992 Lancaster ..... B65D 5/445 220/651
8,511,471 B1 * 8/2013 Sannah ..... B65D 5/48024 229/199
8,833,573 B2 * 9/2014 Tomaszewski ..... B65D 19/385 206/509
9,428,298 B2 * 8/2016 Bersamin ..... B65D 5/006
(Continued)

FOREIGN PATENT DOCUMENTS

GB 2191172 A * 12/1987 ..... B65D 5/445
WO WO-2015066575 A1 * 5/2015 ..... B65D 21/0212

*Primary Examiner* — Nathan J Newhouse
*Assistant Examiner* — Phillip D Schmidt
(74) *Attorney, Agent, or Firm* — Dekel Patent Ltd.; David Klein

(57) ABSTRACT

A shipping assembly includes a folded core, made of corrugated carton or other foldable material, formed with a hollow center along the entirety or a portion of the core. A base at a bottom of the folded core is foldable along a folding line to attain a perpendicular position to the folded core. The base has two protrusions above the folding line. Upper and lower lateral members include two folded tabs which are inserted in upper and lower portions, respectively, of the column assembly to form a frame assembly. The frame assembly is affixed to an inner volume of a box.

7 Claims, 6 Drawing Sheets

(56) References Cited

U.S. PATENT DOCUMENTS

| | | | | |
|---|---|---|---|---|
| 9,783,333 | B1 * | 10/2017 | De Los Santos | B65D 5/006 |
| 9,926,100 | B2 * | 3/2018 | Adams | B65D 5/4804 |
| 2022/0258906 | A1 * | 8/2022 | McLeod | B65D 5/48034 |

* cited by examiner

SHIPPING APPARATUS

FIELD OF THE INVENTION

The present invention relates to packaging, in particular for flowers, chicks and the like.

BACKGROUND OF INVENTION

European Patent 3083424 describes a shipping assembly for agricultural products, which includes sets of columns and girders connected together to form a frame. An envelope including a flat foldable material is affixed to the frame. The envelope determines a distance between the columns. The envelope is adapted to hold therein flowers.

SUMMARY

The present invention seeks to provide further developments to the shipping assembly of European Patent 3083424, as is described hereinbelow.

For example, the invention uses a frame made of folded material such as corrugated carton or hard board carton, instead of plastic. This change in materials eliminates the need for plastic components of the frames which require additional care from the unpackers; plastic also has higher costs in comparison to standard carton boxes. The present invention addresses the growing awareness to reduce plastics usage, even when it is possible to dispose of the carton in sustainable manners such as recycling, as done with empty cartons.

The invention addresses the environmental concern by reducing the weight-to-volume ratio of the package and allowing for packing a higher pack rate in comparison to standard cut-flowers shipping boxes. This translates directly in reducing the carbon footprint of the product. In comparison tests between this invention and regular boxes of the same volume, a difference of up to 18% was found in weight of packaging materials per stem, reducing the carbon footprint accordingly.

The present invention also introduces the ability for inner strapping of the flowers by use of straps or rubber bands.

The upper lateral part of the frame is used as ergonomic handles and allows for keeping the flowers within stable and not shifting during handling.

BRIEF DESCRIPTION OF THE DRAWINGS

The present invention will be understood and appreciated more fully from the following detailed description taken in conjunction with the appended drawings in which.

DESCRIPTION OF EMBODIMENTS OF THE INVENTION

Figure 1:
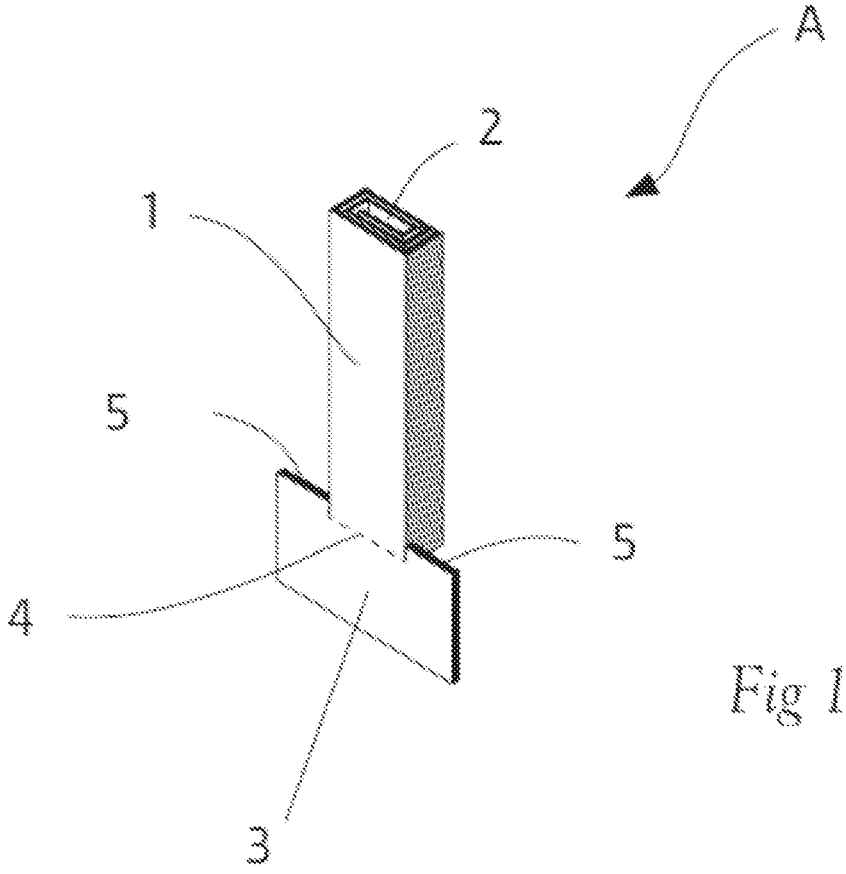
FIG. 1 illustrates member A representing the vertical part of the frame.

FIG. 1 shows member A representing the vertical part of the frame. It consists of a folded core (1), made of corrugated carton or other foldable material, forming a hollow center (2) along the entirety or a portion of the core. The base (3) at the bottom of the folded core (1) folds along line (4) to reach a perpendicular position to the core. The base has two protrusions (5) found above the folding line (4). When the base (3) is folded along (4), these protrusions (5) extend out from the folding line to form anchors that will hold the frame steady in a predefined position in the box (as will be further shown in FIG. 5).

Figure 2:
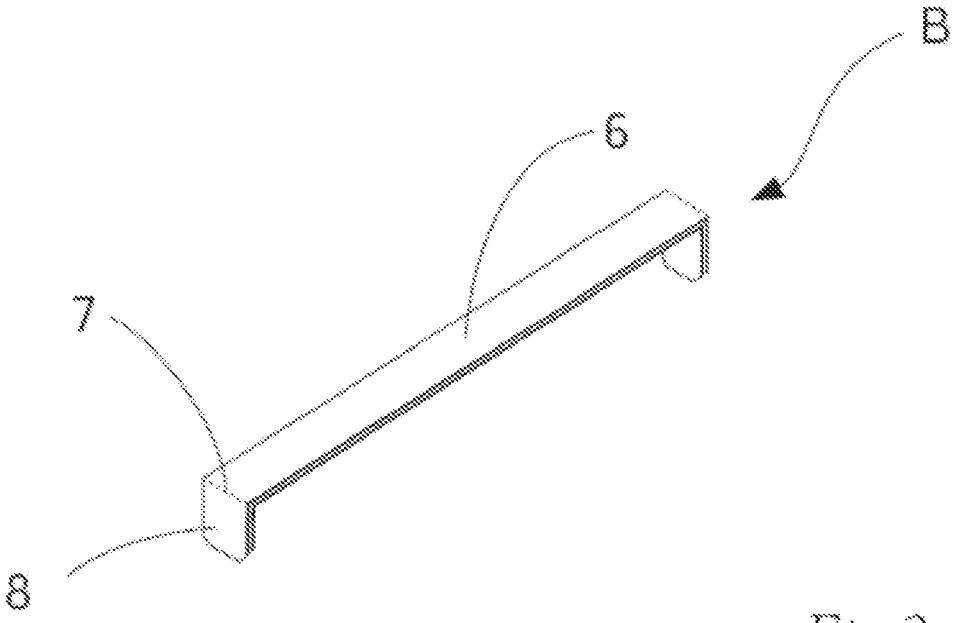
FIG. 2 illustrates member B of the frame representing the lateral part of the frame.

FIG. 2 shows member B of the frame representing the lateral part of the frame. It consists of a flat strip of corrugated carton (or other foldable material) (6) which can be folded further along itself to obtain a stronger lateral. When the strip is folded along lines (7), two shorter folds (tabs) (8) are formed.

Figure 3:
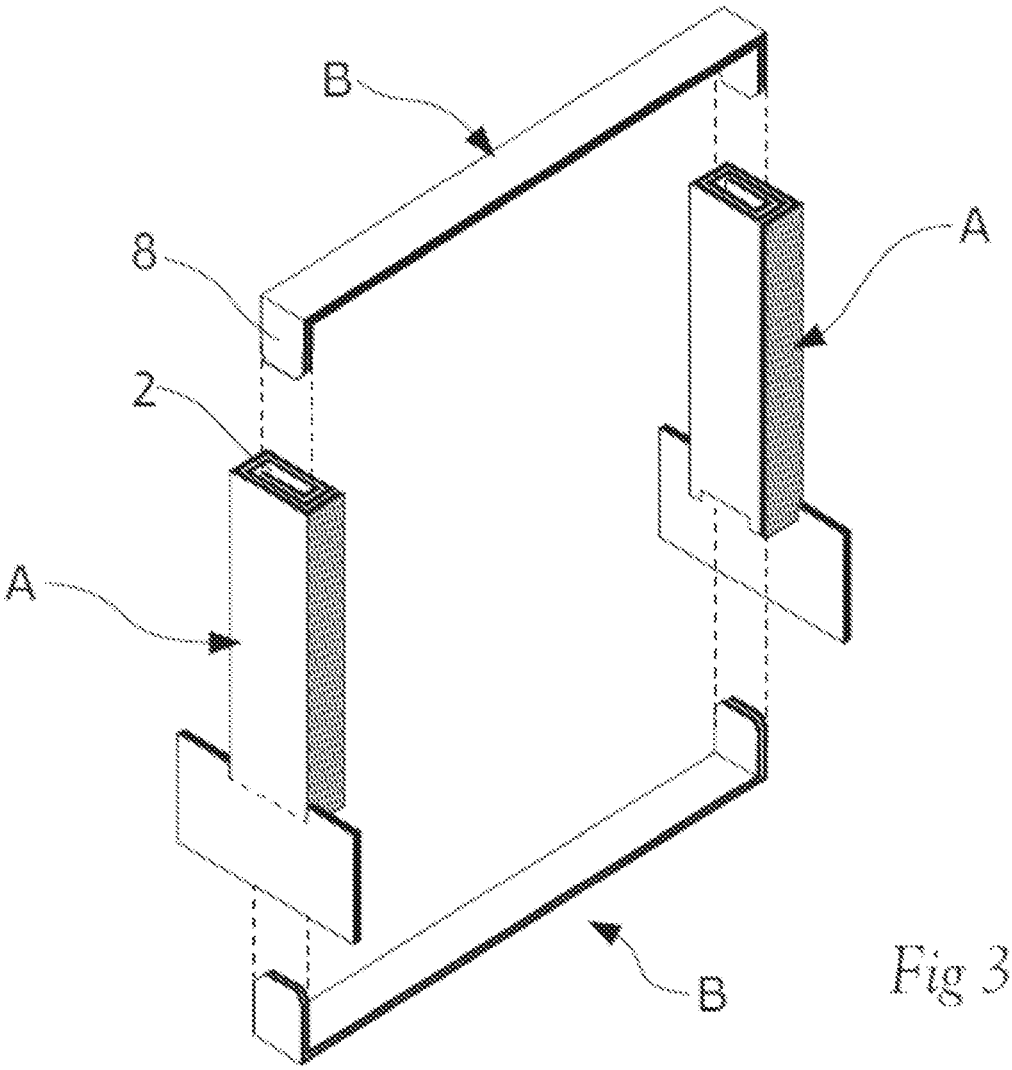
FIG. 3 illustrates the assembly of members A and members B to form the full frame.

FIG. 3 shows the assembly of members A and members B to form the full frame. Parts (8) of member B will be inserted in the hollows (2) of columns A.

Figure 4:
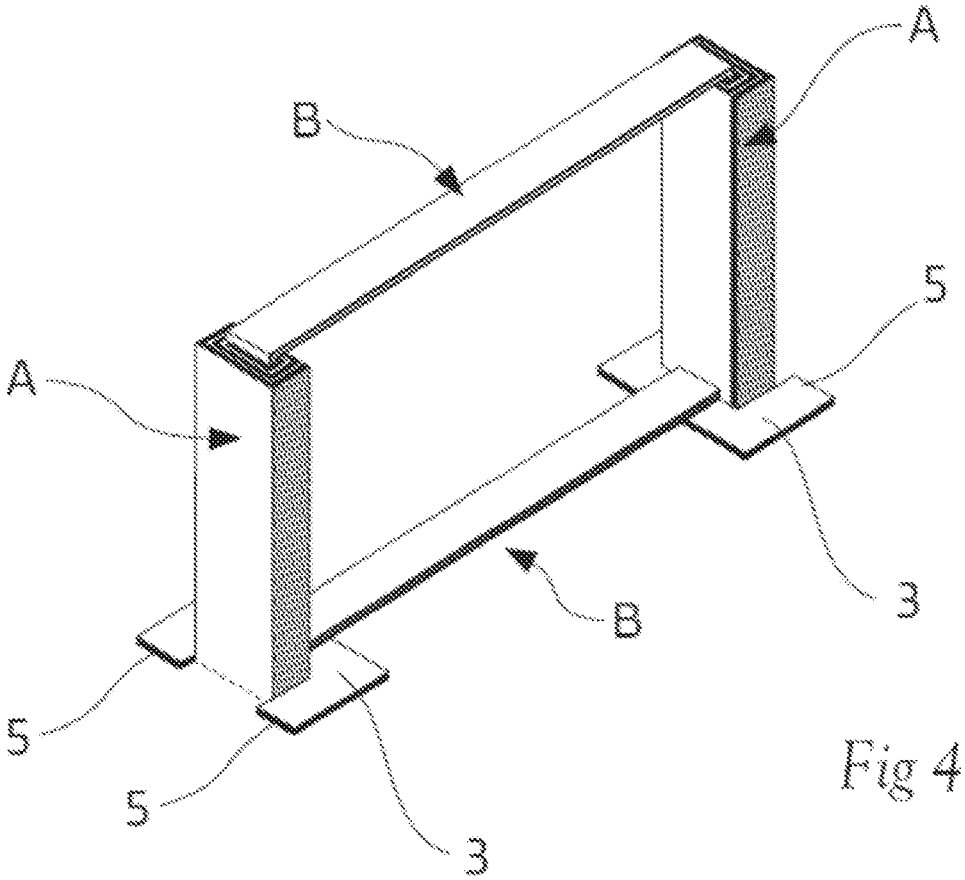
FIG. 4 illustrates the assembled frame with bases (3) of member A folded and protrusions (5) of member A extending away from the frame.

FIG. 4 shows the assembled frame with bases (3) of member A folded and protrusions (5) of member A extending away from the frame.

Figure 5:
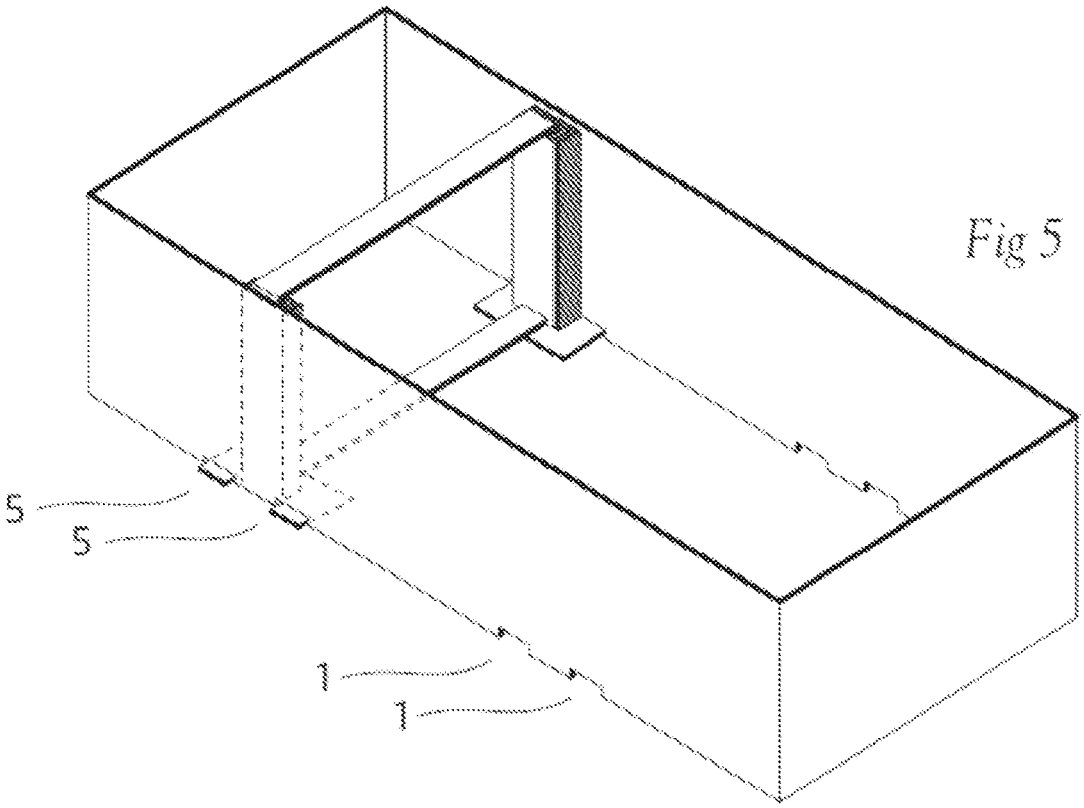
FIG. 5 illustrates frame positioned into a box having a plurality of openings (1) in which the protrusions (5) of the frames fit.

FIG. 5 shows the frame positioned into a box having a plurality of openings (1) in which the protrusions (5) of the frames fit and keep the frame in at a fixed distance from each other and from the extremities of the box.

Figure 6:
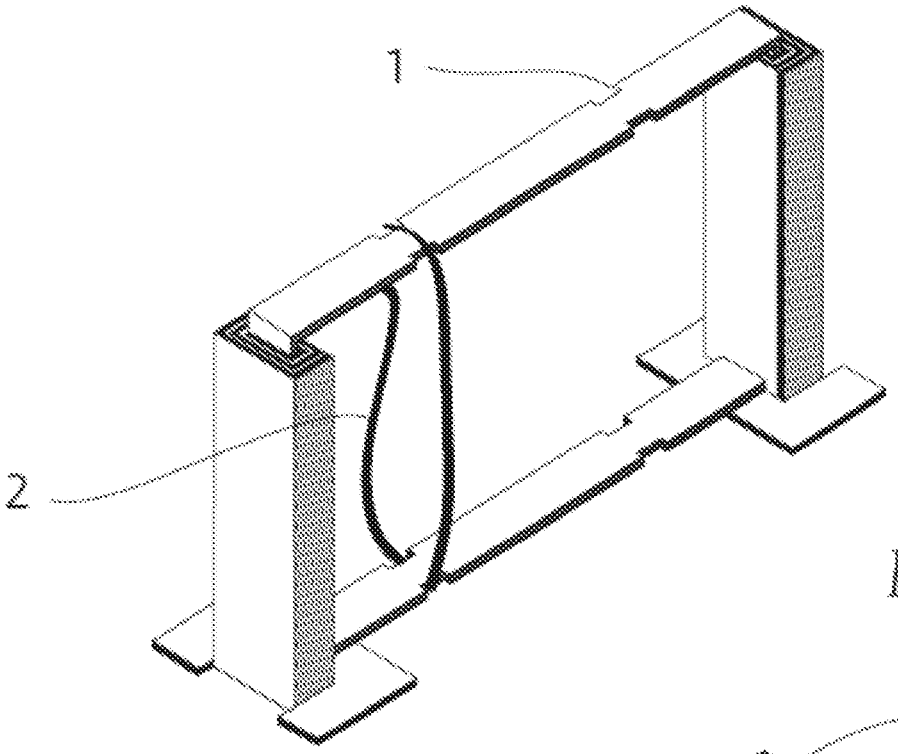
FIG. 6 illustrates lateral members with different notches or slits to help stabilizing the bunches of flowers in the box.

FIG. 6 shows that the laterals can be equipped with different notches or slits to help stabilizing the bunches of flowers in the box. For example, notches (1) can be used to stretch rubber bands (2) between top and bottom laterals to apply moderate pressure on the bunches inside the frames. Further stabilization is obtained by the friction between the rubber bands and the bunches.

Figure 7:
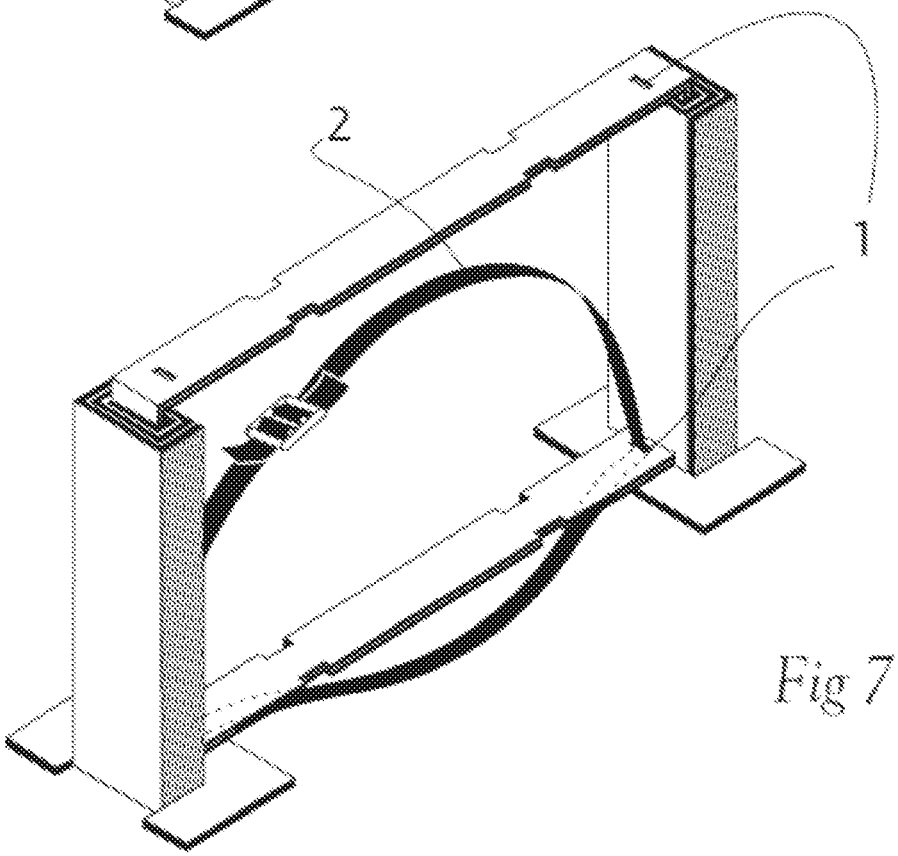
FIG. 7 illustrates another way to stabilize the bunches.

FIG. 7 shows another way to stabilize the bunches, with slits situated at both extremities of the lateral. A plastic strap (2) is threaded through the slits of the lower lateral, tightened around the bunches and kept tight with a buckle. Threading the strap around the bunches and the bottom lateral enables more reliable tightening compared to regular boxes wherein the strap is threaded through the side walls of the box and tear the carton when tightened, resulting in loosening the tension of the strap and thus voiding the procedure.

Figure 8:
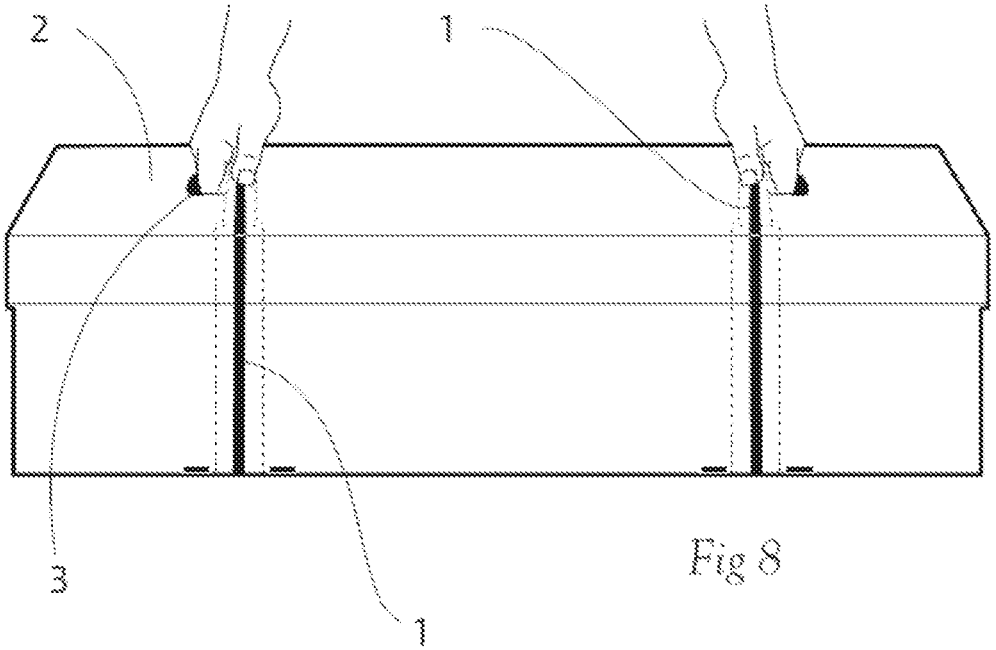
FIG. 8 illustrates the completed box.

FIG. 8 shows the completed box. Two straps (1) are tied around the box at the level of the frames assuring that the lid (2) and the frames inside the box are securely held in place. Holding the box is done through two dedicated openings in the lid (3). The User inserts his fingers through the openings into the box and under the top laterals. When lifting, the straps (1) do not allow the top lid to move up, nor the top laterals (B) to dislodge out of their hollows in columns (A). This allows for safe lifting of the box in its full and maintaining it in horizontal position to avoid possible shifting of the bunches.

Figure 9:
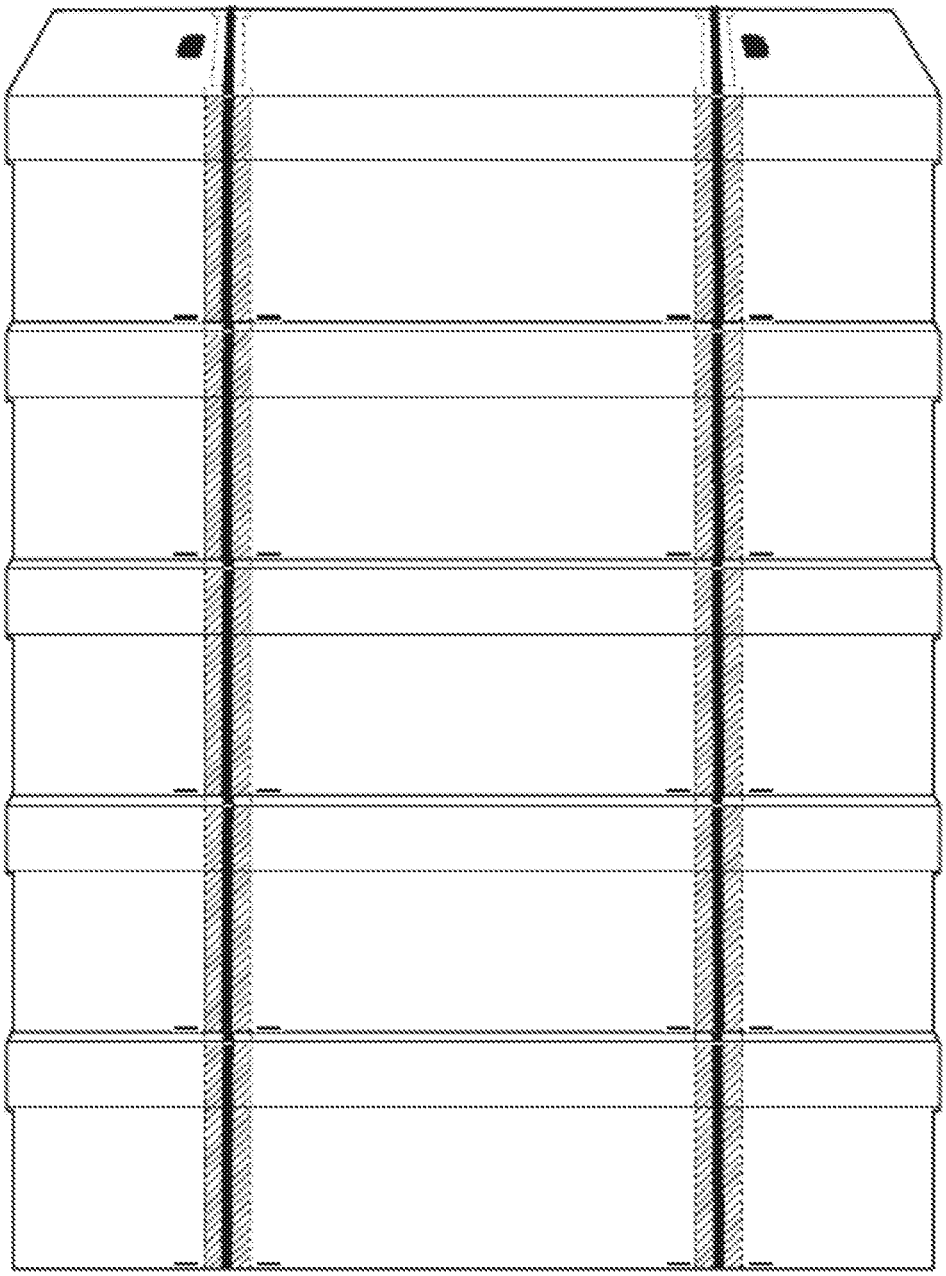
FIG. 9 illustrates plurality of superposed boxes.

FIG. 9 shows a plurality of superposed boxes. Thanks to the positioning method described in FIG. 5, the columns (A) are all aligned exactly one on top of another, thus forming a line along which the load of all the boxes is distributed evenly, removing the stress from the side walls of the boxes and diverting it to the frames. This allows for using lighter carton as raw material for the box, thus diminishing the weight of the boxes and the weight of packaging materials per stem and reducing the shipping cost while lowering the carbon foot print of the package and its content.

The invention claimed is:

1. Apparatus comprising:

a shipping assembly comprising a column assembly that comprises a folded core, made of corrugated carton or other foldable material, formed with a hollow center along the entirety or a portion of the core, wherein a base at a bottom of the folded core is foldable along a folding line to attain a perpendicular position to the folded core, said base having two protrusions above the folding line;

upper and lower lateral members, each lateral member being made of corrugated carton or other foldable material and comprising two folded tabs which are inserted in upper and lower portions, respectively into said column assembly to form a frame assembly; and wherein said frame assembly is affixed to an inner volume of a box.

2. The apparatus according to claim 1, wherein said box has a plurality of openings in which the protrusions of the frames fit and keep the frame in at a fixed distance from each other and from the extremities of the box.

3. The apparatus according to claim 1, wherein the lateral members are formed with different notches or slits to help stabilize flowers in the box.

4. The apparatus according to claim 1, wherein slits are formed at both extremities of the lateral member.

5. The apparatus according to claim 1, further comprising at least one strap coupled to the box.

6. The apparatus according to claim 5, wherein said at least one strap is tightenable with a buckle.

7. The apparatus according to claim 1, wherein one said box is superposed on another said box.

* * * * *